United States Patent [19]

Battle

[11] 4,299,365

[45] Nov. 10, 1981

[54] LEAF BAG SPREADER AND HOLDER

[76] Inventor: Walter L. Battle, 220 East 42nd. St., Minneapolis, Minn. 55409

[21] Appl. No.: 65,637

[22] Filed: Aug. 10, 1979

[51] Int. Cl.[3] ..... B65B 67/12; A45C 7/00

[52] U.S. Cl. ..... 248/99; 150/49; 248/95; 280/12 C

[58] Field of Search ..... 150/49, 1, 2.7, 51; 248/95, 76, 75, 99; 15/257.9; 280/12 C, 12 R, 12 S

[56] References Cited

U.S. PATENT DOCUMENTS

| | | | |
|---|---|---|---|
| 2,600,439 | 6/1952 | Slone | 150/49 |
| 2,612,926 | 10/1952 | Mauro et al. | 150/49 |
| 2,731,184 | 1/1956 | Thurber, Jr. | 248/99 |
| 3,161,391 | 12/1964 | Bahnsen | 248/99 |
| 3,653,619 | 4/1972 | Plum | 248/99 |
| 3,754,785 | 8/1973 | Anderson | 248/99 X |
| 3,806,146 | 4/1974 | Shaw | 280/12 C |
| 3,868,155 | 2/1975 | Cherubini | 150/49 X |
| 3,905,406 | 9/1975 | Cruse | 248/95 X |
| 3,934,803 | 1/1976 | Paulus, Jr. | 248/99 |
| 4,006,928 | 2/1977 | Beugin | 248/99 X |
| 4,023,842 | 5/1977 | Harvey | 248/99 |

FOREIGN PATENT DOCUMENTS

| | | | |
|---|---|---|---|
| 202857 | 8/1923 | United Kingdom | 150/49 |

*Primary Examiner*—James T. McCall
*Attorney, Agent, or Firm*—John W. Adams

[57] ABSTRACT

An improved spreader for leaf bags which not only is collapsible for compact packaging and storage but is provided with ground engaging skid elements to permit the same to be dragged along the ground while maintaining the mouth of the bag above the ground to prevent the bag from being pulled from the frame during the dragging operation.

4 Claims, 3 Drawing Figures

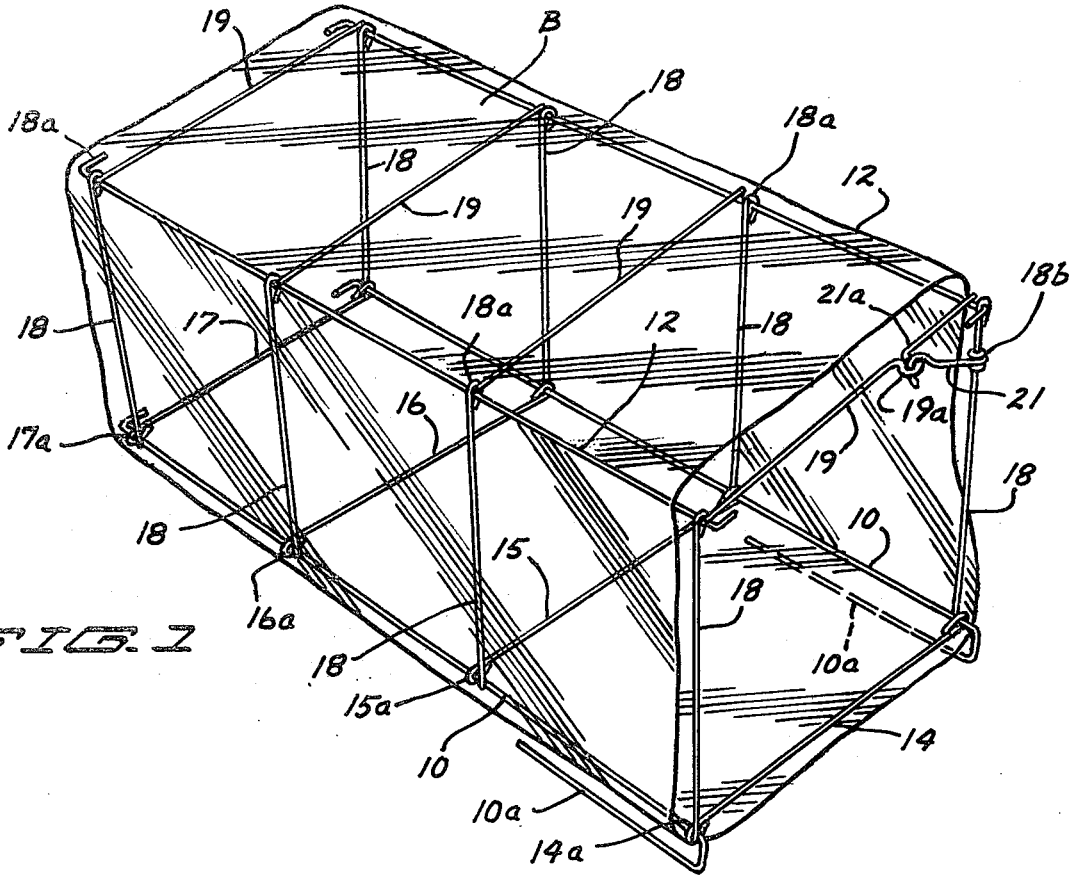
FIG. 1
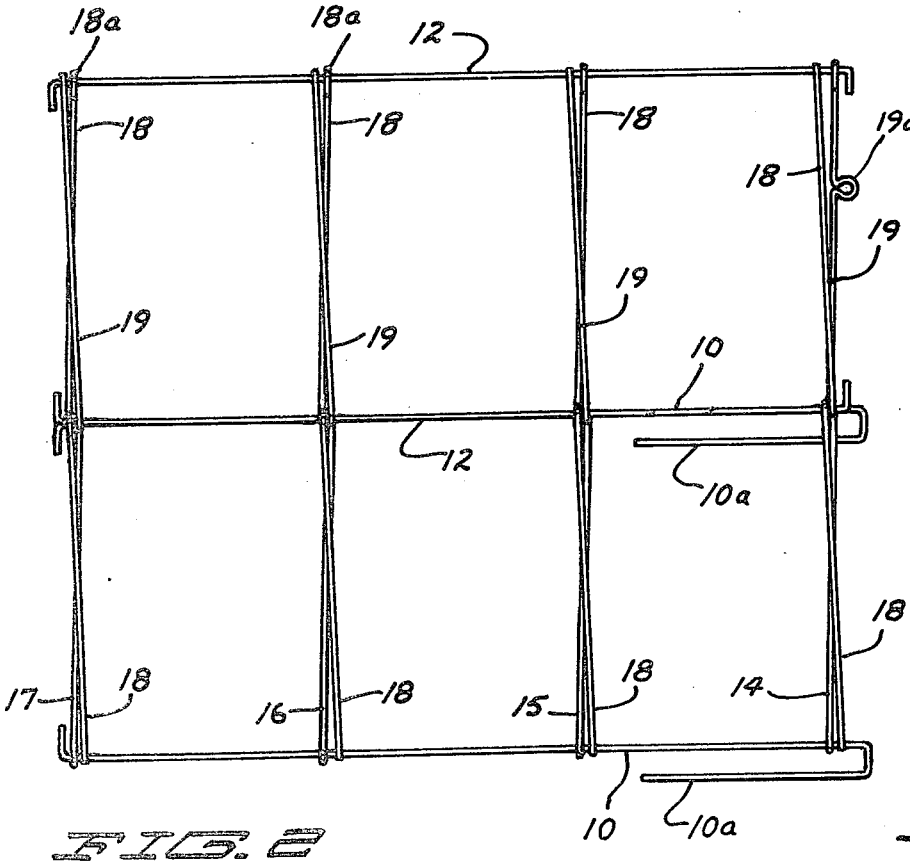
FIG. 2
FIG. 3

LEAF BAG SPREADER AND HOLDER

BACKGROUND OF THE INVENTION

A large number of bag spreading devices have been developed. The prior art known to applicant at the present time consists of the following patents:

| U.S. Pat. No. | Inventor | Issue Date |
|---|---|---|
| 2,731,184 | Thurber | 1-17-56 |
| 3,161,391 | Bahnsen | 12-15-64 |
| 3,754,785 | Anderson | 8-28-73 |
| 3,905,406 | Cruse | 9-16-75 |
| 3,934,803 | Paulus | 1-27-76 |
| 4,006,928 | Beugin | 2-8-77 |
| 4,023,842 | Harvey | 5-17-77 |

All of the above patents listed above are designed to spread at least the mouth portion of a bag and hold the same open to facilitate filling. Applicant's structure is easily collapsible for compact packaging while permitting quick and easy erection into expanded operative position and is provided with ground engaging skids at the front end thereof which underly the bag mounted thereon to facilitate dragging the bag and frame assembly over the ground without tending to pull the bag from the frame.

SUMMARY OF THE INVENTION

The present invention is specifically designed to provide a bag expanding frame assembly which can be readily inserted into a bag such as a trash bag and which will support the bag throughout its entire length and greatly facilitate dragging the bag in a filled or partially filled condition over the ground surface by providing rewardly extending skid elements underlying the lower mouth portion of the bag to prevent contact of forward edge portions of the mouth with the ground surface to facilitate transporting the bag by dragging the same across the ground.

BRIEF DESCRIPTION OF THE DRAWINGS

FIG. 1 is a perspective view showing the frame in expanded operative position within a bag preparatory to filling;

FIG. 2 is a top plan view of the frame in collapsed position; and,

FIG. 3 is an end view of the collapsed frame structure shown in FIG. 2.

DETAILED DESCRIPTION OF A PREFERRED EMBODIMENT

A complete bag expanding frame assembly is provided which includes four longitudinal frame elements in the form of rods. Two of said elements are located on the bottom end and are designated by the numerals 10 and two of said longitudinal elements are located on the top and are designated by numeral 12.

A plurality of cross frame members are provided which include the bottom cross frame members 14, 15, 16 and 17. In the form shown, the cross members 14 through 17 are pivotely connected to the bottom longitudinal members 10 by loops respectively designated by the numerals 14*a*, 15*a*, 16*a* and 17*a* to permit said bottom longitudinal rods 10 to rotate during collapsing.

A plurality of upright side members respectively designated by numeral 18 have their lower ends respectively fixed to the lower longitudinal rods 10 as by being welded thereto so that rotation of the upright members through an approximately 90 deg. arc into collapsed position will produce approximately a 90 deg. rotation of the lower longitudinal rod members 10. The upper cross members are designated by the numeral 19 and may be fixed at their respective end portions to the upper longitudinal rods 12 and extend therebetween.

A pair of skid elements 10*a* are formed in underlying spaced relation to the forward mouth portion of the lower longitudinal frame members 10 and when the longitudinal frame members 10 are rotated through the 90 deg. arc into collapsed position, the skid members will be similarly rotated to lie substantially in the plane defined by the collapsed frame structure. As best shown in FIG. 1, when the frame is in the expanded operative position, the skid elements 10*a* will lie respectively in a vertical plane through the upright sides of frame members 18.

The pivot joints formed by the loops 14*a* through 17*a* and the loops 18*a* provided at the upper ends of the upright members 18 are sufficiently tight on the respective upper longitudinal 12 to frictionally maintain the frame structure in operative expanded relation while still permitting the same to be collapsed with a moderate amount of force being exerted.

The bag B may be of transparent soft plastic sheet material and the entire frame assembly inserted into the bag as best shown in FIG. 1. I have found it is somewhat easier to insert the frame assembly into the bag when the frame is in collapsed position and thereafter expand the frame into operative position with the bag surrounding same. The lower mouth portion of the bag is positioned in the space between the skids 10*a* and the forward portions of the lower longitudinal frame members 10 and the skids 10*a* tend to maintain a space between the ground and the lower mouth portion of the bag B when the bag and frame assembly is supported on the ground. This facilitates the dragging of the bag and frame structure across the ground and prevents the bag from being pulled off from the frame structure by engagement with the ground surface.

In the event that the frictional resistance produced between the connecting pivot loops 14*a* through 18*a* is insufficient to maintain the frame structure in operative expanded relation, a strut element in the form of a hook 21 is provided and is pivotally connected to one of the uprights 19 as at 18*b*. The hook 21 may be inserted through the loop 19*a* provided in the upright cross member 19, as best shown in FIGS. 1 and 2.

It will be seen that this invention provides a relatively simple and inexpensive yet highly efficient bag expanding frame assembly to facilitate filling the bag with leaves or other material by merely raking the same into open mouth of the bag assembly while said assembly positioned on the ground.

What is claimed is:

1. An open ended bag-spreading frame structure comprising, a plurality of longitudinal extending frame members with cross members extended therebetween, the connections between the longitudinal frame members and the cross members permitting the frame structure to be collapsed into a double thickness frame for compact packaging and storage while permitting the same to be erected into expanded operative position having a generally rectangular cross section and being of substantially the same length as the bag into which it is inserted to hold the bag open, said connections between the longitudinal and cross frame members being provided with means for maintaining the frame structure in expanded operative position within a flexible bag, and a pair of skid elements integrally formed with the underlying lower longitudinal frame members in downwardly spaced relation thereto adjacent to the mouth portion of the frame assembly to permit insertion of the bag between the skid elements and the frame and thus maintain the lower portions of the bag in spaced relation above the ground surface with the bag and frame assembly are positioned with the skid elements in ground-engaging orientation.

2. The structure set forth in claim 1 wherein said skid elements are formed by bending the lower frame members back on themselves and the upright members connected to the lower members are in fixed relation thereto to produce axial rotation of said lower frame members when the frame assembly is moved from collapsed position into expanded operative position to shift said skid members from the plane defined by the collapsed frame assembly into the respective side planes defined by the side members of the frame structure when in expanded operative position.

3. The structure set forth in claim 1 and said connections between the longitudinal members and cross members providing sufficient frictional resistance to rotation to maintain the frame in expanded operative position.

4. The structure set forth in claim 1 and the connection between at least one of said longitudinal frame members and an adjacent cross member being supplemented by a diagonal strut member connected at one end to one of said members and releasably connected at the other end to an intermediate portion to the other of said members to prevent collapsing of the frame structure.

* * * * *